US006684866B2

(12) United States Patent
Meinders et al.

(10) Patent No.: US 6,684,866 B2
(45) Date of Patent: Feb. 3, 2004

(54) IGNITION SYSTEM FOR AN INTERNAL COMBUSTION ENGINE

(75) Inventors: Horst Meinders, Reutlingen (DE); Wolfgang Feiler, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/258,935

(22) PCT Filed: Mar. 15, 2001

(86) PCT No.: PCT/DE01/00991

§ 371 (c)(1),
(2), (4) Date: Mar. 13, 2003

(87) PCT Pub. No.: WO01/83982

PCT Pub. Date: Nov. 8, 2001

(65) Prior Publication Data

US 2003/0164165 A1 Sep. 4, 2003

(30) Foreign Application Priority Data

Apr. 29, 2000 (DE) ..... 100 21 170

(51) Int. Cl.[7] ..... F02P 3/02
(52) U.S. Cl. ..... 123/620; 123/637
(58) Field of Search ..... 123/620, 637, 123/621, 634

(56) References Cited

U.S. PATENT DOCUMENTS 4,836,176 A * 6/1989 Fujino et al. ..... 123/640
4,938,200 A * 7/1990 Iwasaki ..... 123/620
5,215,066 A * 6/1993 Narishige et al. ..... 123/620
5,370,099 A 12/1994 Koelle et al.

FOREIGN PATENT DOCUMENTS

| | | |
|---|---|---|
| GB | 1 557 046 | 12/1979 |
| JP | 53-37245 | 4/1978 |
| JP | 1-224475 | 9/1989 |

OTHER PUBLICATIONS

Patent Abstracts of Japan, vol. 13, No. 545 (M–902), Dec. 6, 1989*.

Patent Abstracts of Japan, vol. 2, No. 071 (M–022), May 30, 1978*.

* cited by examiner

*Primary Examiner*—Bibhu Mohanty
(74) *Attorney, Agent, or Firm*—Kenyon & Kenyon

(57) ABSTRACT

An ignition system is for an internal combustion engine having an ignition device that requires a high voltage (ignition voltage) for igniting the ignition spark. Two ignition coils are provided, which have secondary windings that are each connected to electrodes of a spark plug, which have primary windings that may be connected in each case by a switching arrangement to a supply voltage source, and a drive circuit, via which the ignition coils are driven in a time-displaced manner.

9 Claims, 7 Drawing Sheets

Fig.4
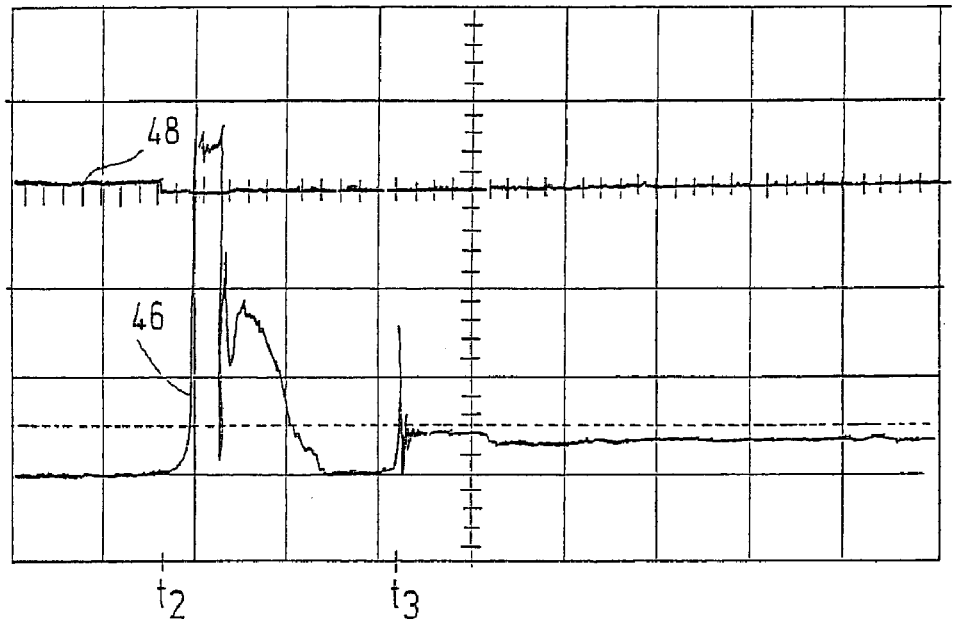
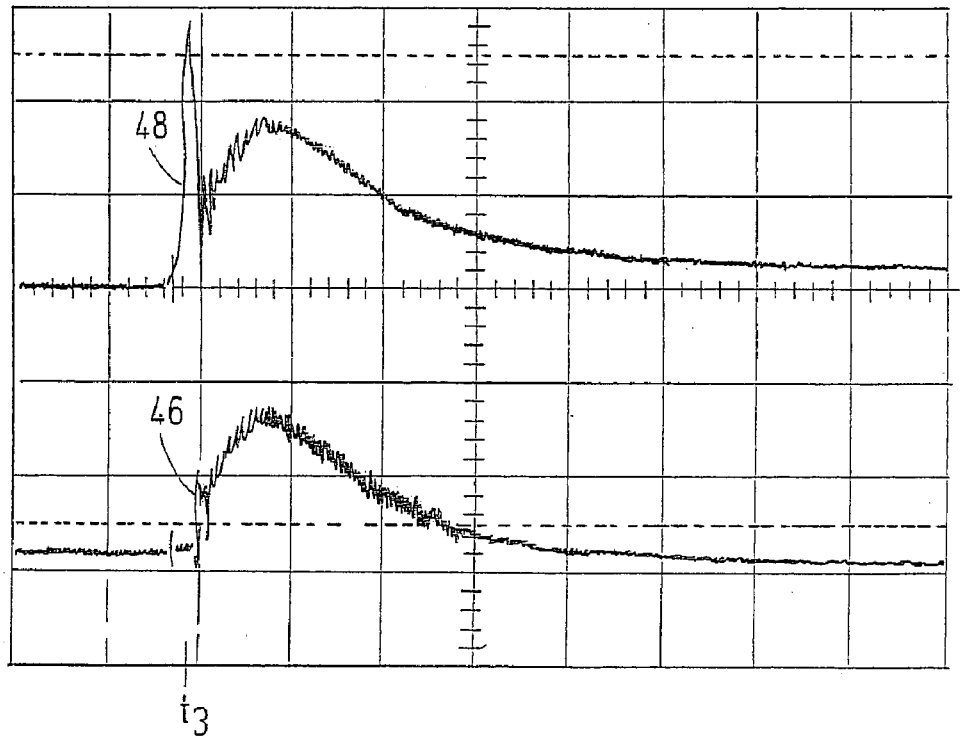
Fig.5

IGNITION SYSTEM FOR AN INTERNAL COMBUSTION ENGINE

FIELD OF THE INVENTION

The present invention relates to an ignition system for an internal combustion engine.

BACKGROUND INFORMATION

Ignition systems act to ignite a compressed fuel-air mixture in the internal combustion engine. For this purpose, using an ignition device, usually a spark plug, an arc discharge is generated between two electrodes of the spark plug. To generate this arc discharge, an ignition voltage in the high-voltage range is made available. To make this necessary high voltage available, a spark plug may be connected to the secondary winding of an ignition coil which has a primary winding that can be connected to a voltage source, which in motor vehicles is usually the motor vehicle battery. In this context, the ignition coil operates as an energy storage device and as a transformer. During the closing time of the primary-side switching means, the electrical energy made available from the voltage source is stored in the magnetic field of the ignition coil, and, at the ignition time point, it is made available as a high-voltage ignition pulse.

To ignite the compressed fuel-air mixture, a specific minimum ignition energy is necessary. The level of this minimum ignition energy is a function of the stochiometric composition of the fuel-air mixture. In particular, when the fuel-air mixture is lean, i.e., air is present in stochiometric excess, then an increased minimum ignition energy is necessary. If this minimum ignition energy is not made available, the result can be the incomplete combustion of the fuel-air mixture or ignition misfiring. The conventional options for influencing the combustion process are in varying the spark duration and/or the spark current. To increase the spark duration and/or the spark current, it is conventional to increase the energy that is stored on the primary side of the ignition coil, for example, by increasing the primary current on the primary side. In this context, however, a disadvantage arises where it is necessary to select a correspondingly large design of an ignition coil. The large design of the ignition coil hampers the goal of optimizing the overall installation volume.

SUMMARY

The ignition system according to the present invention may provide high ignition energy, which may be adequately proportioned in every operating situation of the internal combustion engine, especially in igniting lean fuel-air mixtures. As a result of the fact that two ignition coils are provided, each having a secondary winding that is connected to one spark plug and with primary windings that may each be acted upon by a switching arrangement using the supply voltage, and that a drive circuit is provided which allows a time-displaced driving of the switching arrangement and therefore of the ignition coils, it may be possible to switch on the second ignition coil precisely at the time point at which, in the voltage circuit of the first ignition coil, the switch-off voltage results in the secondary-side generation of the high voltage. In this manner, on the high-voltage side of the second ignition coil, a positive switch-on voltage arises, which is added to the negative spark voltage of the ignition spark generated by the first ignition coil, and therefore the spark voltage present at the ignition electrodes of the spark plug is increased, specifically, more than doubled. In this manner, a greater ignition spark duration and a higher ignition spark current are obtained, resulting generally in making available greater ignition energy. This high ignition energy may be well-suited to reliably igniting even lean fuel-air mixtures every time. By connecting in alternating fashion the other ignition coil in the switch-off phase of the previously connected ignition coil, it is possible repeatedly to extend the spark duration over a longer time period.

The present invention is discussed in greater detail below in exemplary embodiments on the basis of the attached drawings.

BRIEF DESCRIPTION OF THE DRAWINGS

FIGS. 2 through 7 are various characteristic curves of the ignition system.

DETAILED DESCRIPTION

Figure 1:
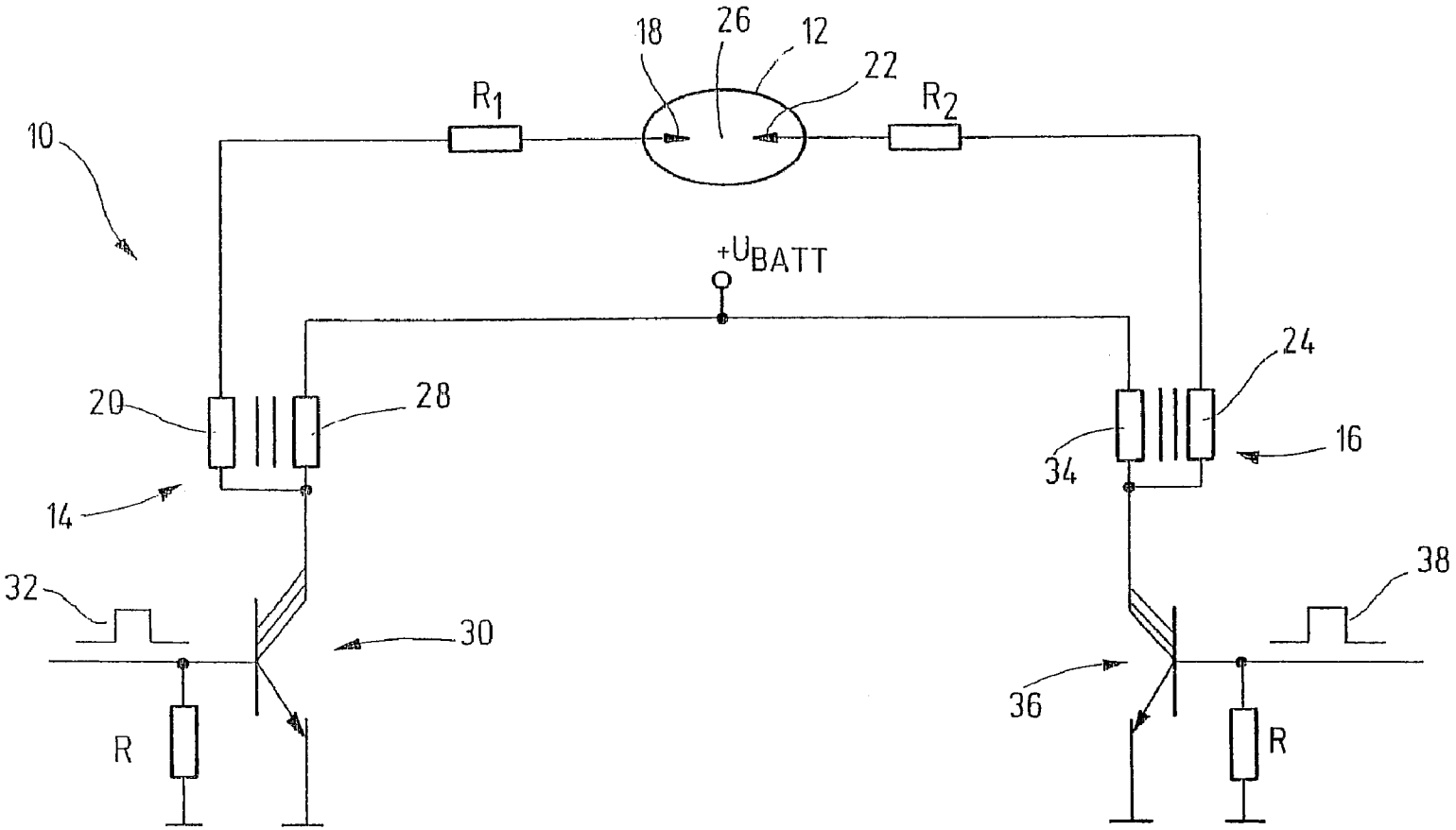
FIG. 1 is schematic diagram of an ignition system in a circuit diagram.
Figure 2:
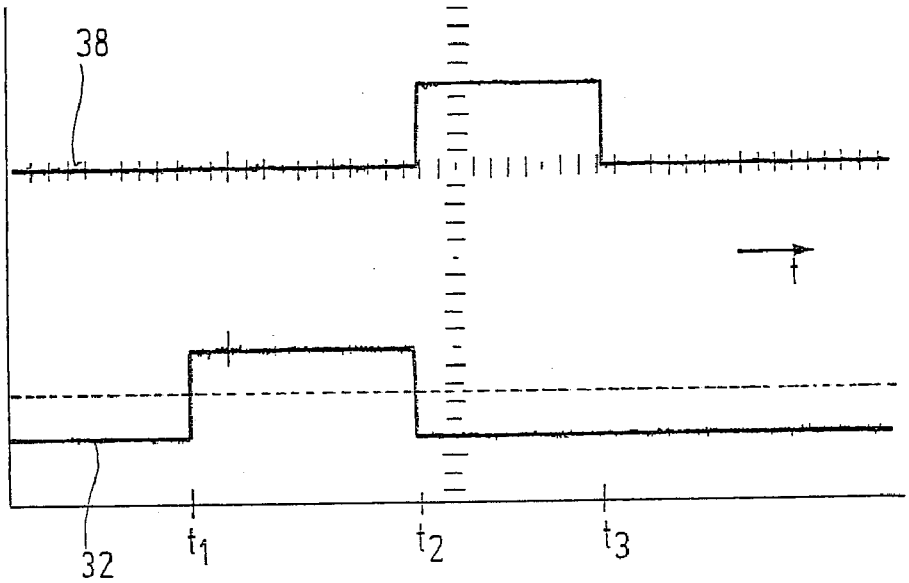

FIG. 1 illustrates an ignition system, designated overall as 10, in a substitute circuit diagram. Ignition system 10 includes a spark plug 12, to which is assigned a first ignition coil 14 and a second ignition coil 16. One electrode 18 of ignition coil 12 is connected to secondary winding 20 of first ignition coil 14. Second electrode 22 of spark plug 12 is connected to secondary coil 24 of second ignition coil 16. An ignition gap 26 is configured between electrodes 18 and 22. Between electrodes 18 and 22, and secondary coils 20 and 24, respectively, a resistor $R_1$, and $R_2$, respectively, is connected. Primary coil 28 of first ignition coil 14 is connected on one side to a supply voltage source $U_{BATT}$, in motor vehicles usually the motor vehicle battery. On the other side, primary winding 28 is connected to the secondary winding and a switching arrangement 30. Switching arrangement 30 is a three-phase Darlington transistor. Alternatively, secondary winding 20, via a switch-on suppression diode D, may also be connected at the anode to the secondary winding and at the cathode to ground. The emitter of switching arrangement 30 contacts ground. The base of switching arrangement 30 is connected to a drive circuit that is not depicted in any greater detail and is acted upon by a control signal 32 that is indicated schematically. Primary winding 34 of second ignition coil 16 is also connected, to supply voltage source $U_{BATT}$ and, to a switching arrangement 36 which is also configured as a three-phase Darlington transistor. The emitter of switching arrangement 36 contacts ground, whereas the base of switching arrangement 36 is connected to the drive circuit and may be acted upon by a control signal 38.

The functioning of ignition system 10 is discussed on the basis of characteristic curves that are illustrated in FIGS. 2 through 9.

The configuration and function of ignition coils that are driven by Darlington ignition transistors and the generation of an ignition spark are generally conventional, so that in the context of the present description only specific points in accordance with the present invention are discussed. Switching arrangements 30 and 36 are driven by control signals 32 and 38, which have curves illustrated, as an example, in FIG. 2. Control signals 32 and 38, in this context, are made available by the drive circuit in a time-displaced fashion.

I.e., at the switch-off time point of control signal 32, i.e., when the latter falls from the level "high" to the level "low," control signal 38 is connected, i.e., it rises from its level "low" to the level "high." In this context, each of switching arrangements 30 and 36 may be acted upon by a control pulse, or switching arrangement 30 and 36 may be alternately acted upon by their control pulses 32, 38, respectively, the level "high" each time being time-displaced.

By having switching arrangement 30 acted upon by control signal 32, the former is switched through during the switch-on period, so that primary coil 28 of first ignition coil 14 receives current. At the switch-off time point of switching arrangement 30, there arises in the collector of switching arrangement 30 a switch-off voltage (clamping voltage), which results in the induction of a high voltage at secondary coil 20. This high voltage is applied via resistor $R_1$ at electrode 18 and results in creating an ignition spark between electrodes 18 and 22 of spark plug 12. Precisely at this time point, switching arrangement 36 may be switched on by being driven by a control signal 38, so that primary coil 34 of second ignition coil 16 receives current. In this manner, in secondary winding 24 of second ignition coil 16, a positive switch-on voltage is induced, which is added to the negative spark voltage of the ignition spark that is generated by ignition coil 14. Thus, the spark voltage applied at electrodes 18 and 22 is increased. The high voltage supplied by first ignition coil 14 may be in the range of 800 V to 1200 V, as an example, whereas the positive switch-on voltage of the second ignition coil may be in the range of 1200 V to 1700 V. Therefore, the spark voltage applied at electrodes 18 and 22 may be more than doubled by connecting second switching arrangement 36 and thus second ignition coil 16. As a result of this increased ignition voltage, the duration of the ignition spark and of the ignition spark current is increased, so that greater energy may be transferred in the arcing sparks.

When second ignition coil 16 is switched off, a spark voltage is generated that has a reversed polarity. If, subsequently in the switch-off procedure of ignition coil 16, ignition coil 14 is connected in an analogous manner, then once again the positive switch-on voltage of first ignition coil 14 is added to the spark voltage of the new ignition spark.

Figure 3:
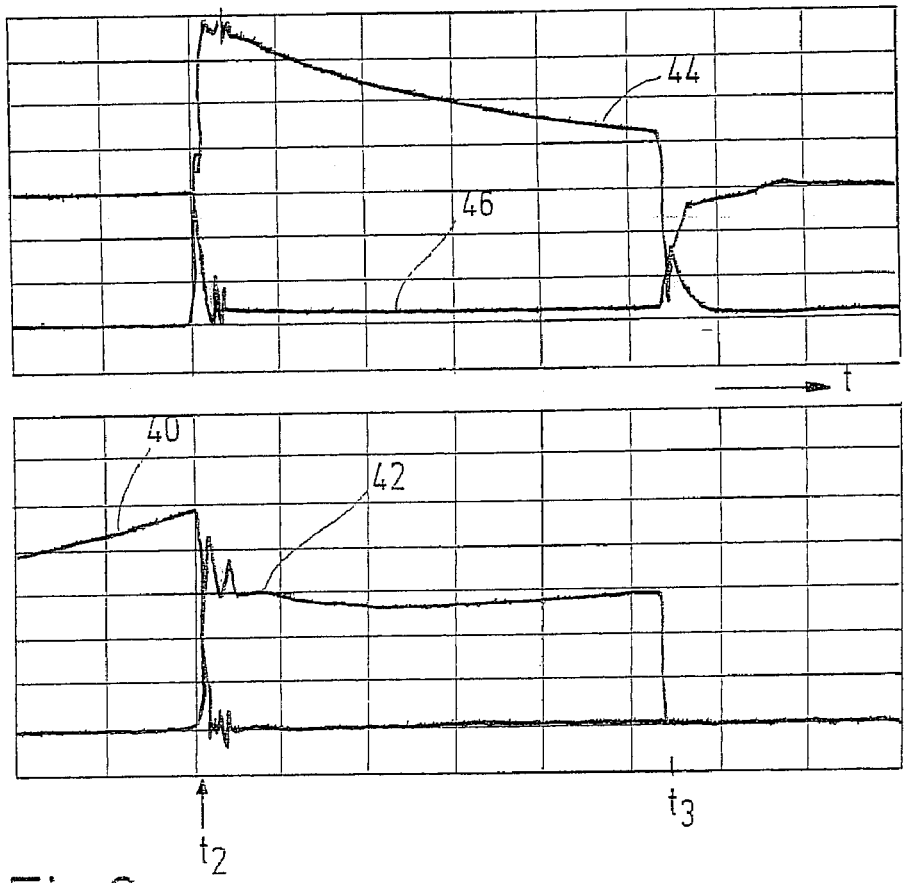

In FIG. 3, the curve of the collector current of switching arrangement 30 (characteristic curve 40), the collector current of switching arrangement 36 (characteristic curve 42), the curve of the ignition current (characteristic curve 44) at spark plug 12, and the curve of the clamping voltage of switching arrangement 30 (characteristic curve 46) are illustrated.

Via the high-voltage side of ignition coil 14 and the high-voltage side of ignition coil 16, which are connected in response to closing an ignition current, in primary winding 34 of second ignition coil 16 a voltage is induced which results in a current commutation at the primary side of ignition coil 16 as illustrated in the characteristic curves. This current commutation is brought about by suddenly igniting the ignition spark in primary winding 34, which previously had not received current, i.e., was cold. The slope of characteristic curve 42 illustrates that at switch-off time point $t_2$ of first switching arrangement 30, the ignition spark ignites and therefore the commutated current flowing at primary winding 34 of ignition coil 16 abruptly rises at a steep slope, and it subsequently falls, in order to rise once again. This temporary falling of the current commutated at the primary side of ignition coil 16 derives from the heating of primary winding 34. Characteristic curve 40 illustrates that at switch-off time point $t_2$ of switching arrangement 30, the charging current of ignition coil 14 falls. According to characteristic curve 40, the charging current in the primary circuit of ignition coil 14 slowly rises at a relatively flat charging slope, whereas in the primary circuit of ignition coil 16, the charging current, as discussed, rises sharply.

The ignition current at spark plug 12 (characteristic curve 44) rises suddenly to a maximum value when switching arrangement 30 is switched off and falls over the duration of the ignition spark until time point $t_3$. At time point $t_3$, the primary circuit of ignition coil 16 is switched off, so that the arcing current flows in the opposite direction and initially falls to a negative maximum value, in order subsequently once again to rise to zero. The curve of the clamping voltage (characteristic curve 46) of switching arrangement 30 illustrates the voltage jump at switch-off time point $t_2$, which results in igniting the ignition spark, and a voltage jump at time point $t_3$.

FIG. 4 illustrates a characteristic curve 46 (clamping voltage $U_{CE}$) of switching arrangement 30. In addition, the curve of clamping voltage $U_{CE}$ (characteristic curve 48) of switching arrangement 36 is illustrated. FIG. 5 illustrates the curve of clamping voltages $U_{CE}$ of switching arrangement 30 and 36, respectively, as of time point $t_3$. On the basis of FIGS. 4 and 5, according to characteristic curve 46 in FIG. 4, the rise of the clamping voltage at time point $t_2$ occurs during the ignition of the ignition spark and the subsequent feedback of the burning ignition spark onto primary winding 28, and a voltage spike occurs at time point $t_3$, from which subsequently the clamping voltage sinks to the supply voltage. At time point $t_3$, the result is therefore a coupling vibration acting on primary coil 28 of ignition coil 14. Clamping voltage 48 of switching arrangement 36 falls at time point $t_2$ from the supply voltage level to the saturation voltage level. At time point $t_3$, the clamping voltage of switching arrangement 36 rises sharply, as characteristic curve slope 48 in FIG. 5 illustrates, and it then subsides to the transformed spark voltage of the ignition spark. In FIG. 5, in characteristic curve 46, once again the voltage jump at time point $t_3$ is indicated in response to the clamping voltage of switching arrangement 30. Subsequently, there occurs once again a subsiding to the transformed spark voltage of the ignition spark.

Figure 6:
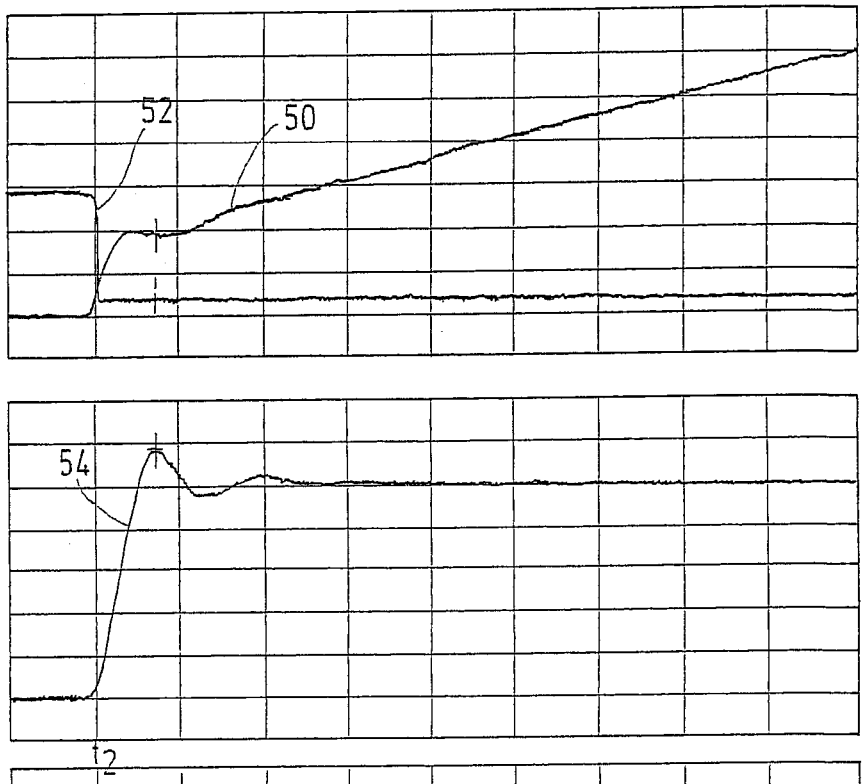
Figure 7:
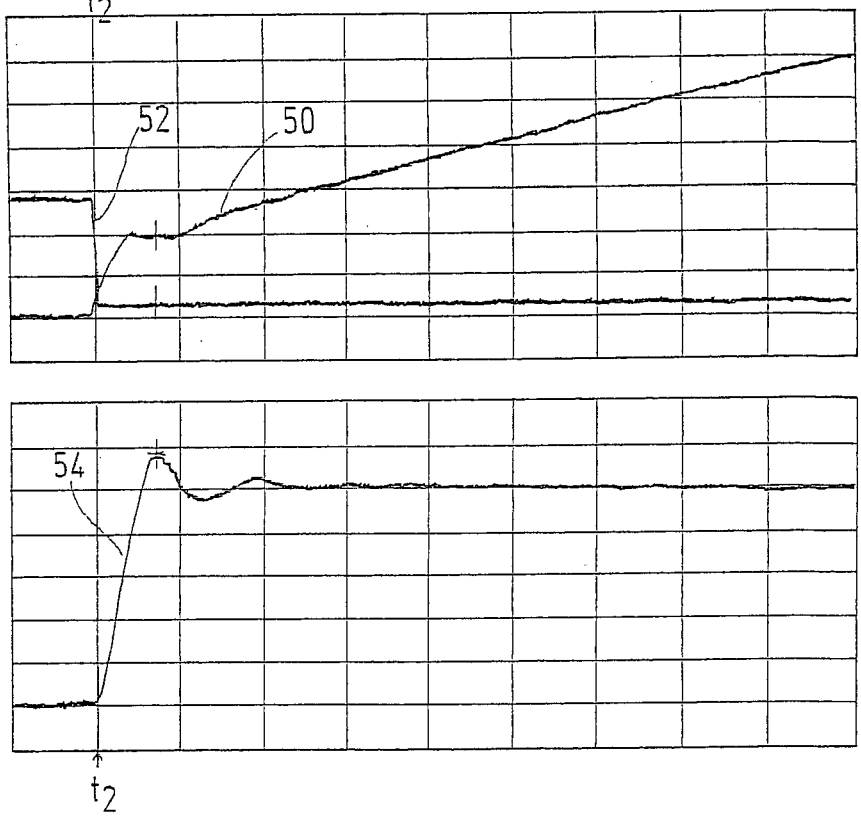

In FIGS. 6 and 7, the curve of switch-on voltage $U_{CE}$ (characteristic curve 50), the curve of switch-on current $I_C$ (characteristic curve 52) of switching arrangement 30, and the curve of the secondary voltage (characteristic curve 54) of ignition coil 14 are compared in the case of a standard ignition system (FIG. 6) and in the case of double-coil ignition system 10 according to the present invention (FIG. 7). It is clear that in double-coil ignition system 10, switch-on voltage $U_{CE}$ has the same curve and the same stroke as in the case of conventional ignition systems. To avoid so-called switch-on sparks when switching arrangement 30 is switched on, high-voltage diodes are used in the conventional ignition systems. In double ignition system 10 according to the present invention, as a result of coupling the secondary sides of both ignition coils 14 and 16, high-voltage diodes of this type cannot be used. For this purpose, separate circuit arrangements may be used for reducing voltage.

Figure 8:
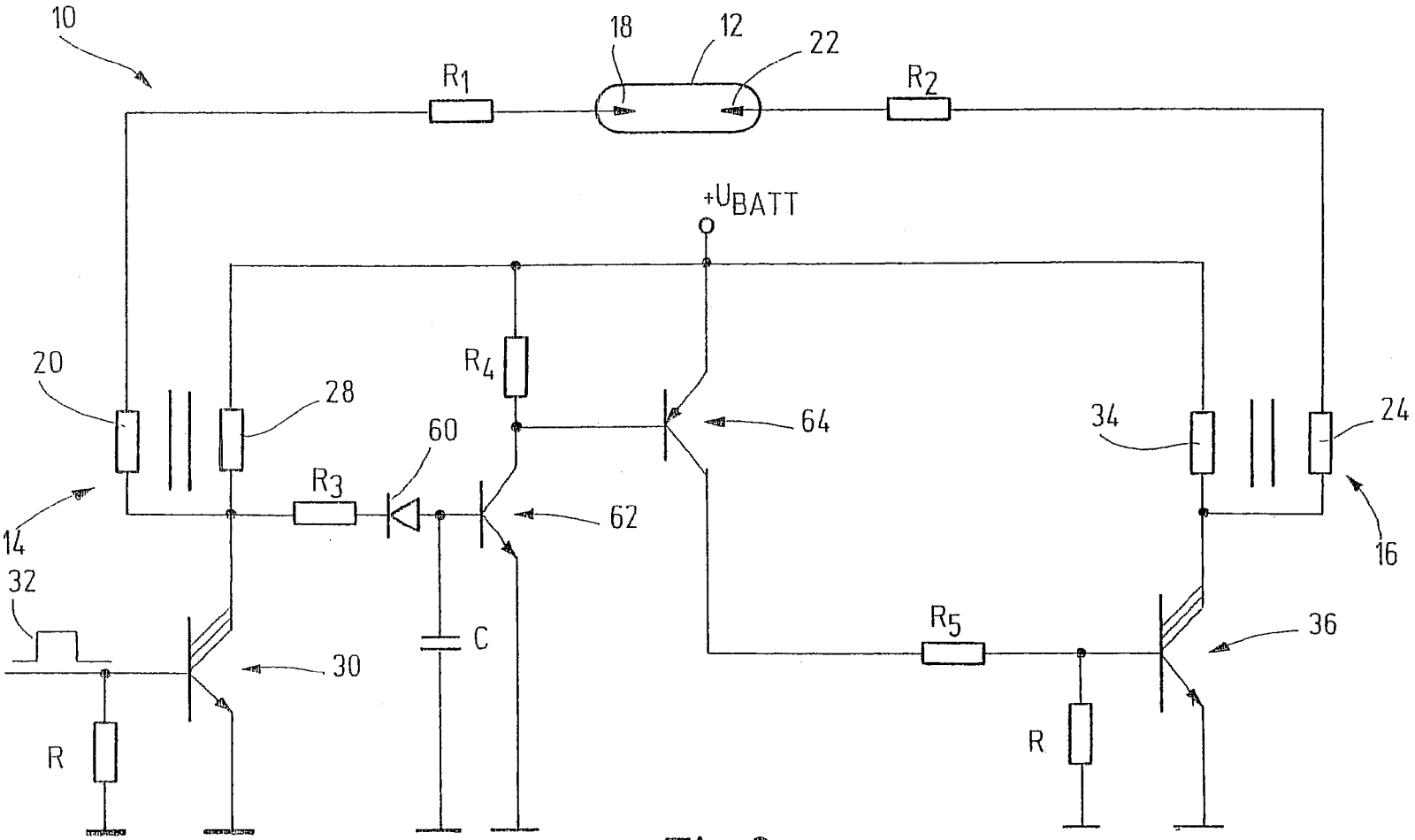
FIGS. 8 through 10 are circuit diagrams of ignition systems in other example embodiments.

In FIG. 8, a transformed circuit arrangement of ignition system 10 is illustrated. The identical parts as in FIG. 1 are provided with identical reference numerals and are not discussed once again.

The difference with respect to the circuit variant illustrated in FIG. 1 is that second switching arrangement 36 is not actuated via a control signal 38 from the drive circuit, but rather switching arrangement 36 is turned on as a function of the spark voltage of the ignition spark of spark plug 12. For this purpose, the collector of switching arrangement 30 is connected via a resistor $R_3$ to the cathode of a Zener diode 60. The anode of Zener diode 60 is connected to the base of a transistor 62 and to a first terminal of a capacitor C, which has another terminal is connected to ground. The emitter of transistor 62 is also connected to ground, whereas the collector of transistor 62 is connected to the base of a further transistor 64 and to a resistor $R_4$. An emitter of transistor 64 is connected to supply voltage $U_{BATT}$, whereas the collector of transistor 64 is connected via a resistor $R_5$ to the base of switching arrangement 36 (Darlington ignition). A breakdown voltage of Zener diode 60 is, for example, 20 V.

The transistor 62 is driven by the transformed spark voltage of the ignition spark when it exceeds the breakdown voltage of Zener diode 60, which is here 20 V as illustrated by the circuit arrangement of FIG. 8. Resistor $R_3$, in this context, acts as a current-limiting resistor. If transistor 62 is switched through, then it connects transistor 64, which subsequently connects supply voltage $U_{BATT}$ to the base of switching arrangement 36, so that the latter is also switched through. In this context, capacitor C acts to dampen the emitter-base path of transistor 62 due to the fluctuating spark voltage, which is applied at the base of transistor 62.

Figure 9:
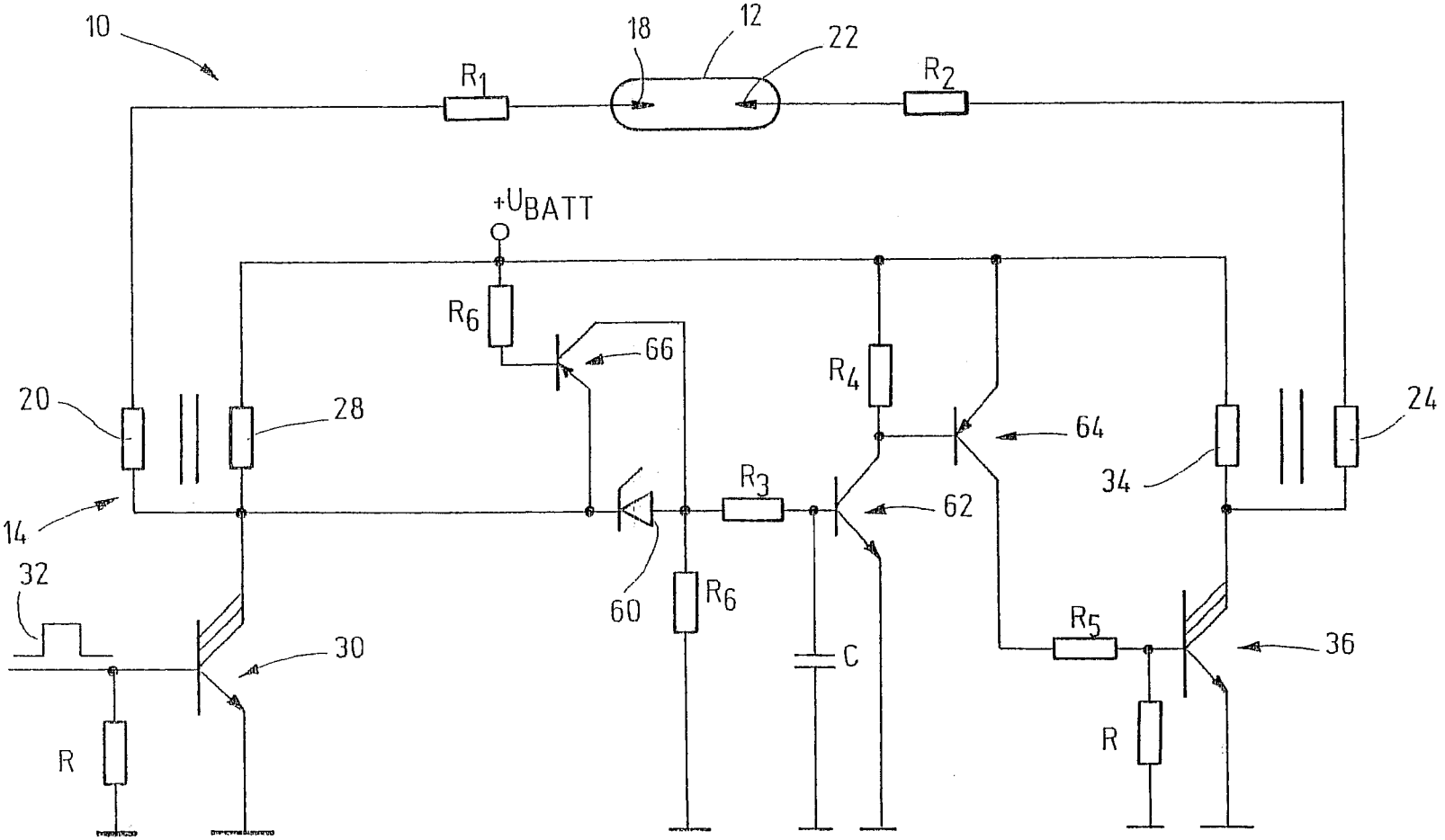

FIG. 9 illustrates a circuit variant that is transformed in comparison to FIG. 8, in which the collector of switching arrangement 30 is connected to the cathode of a Zener diode 60'. The collector of switching arrangement 30 is connected to an emitter terminal of a transistor 66, the collector of which is connected via a resistor $R_3$ to the base of transistor 62. In addition, the collector of transistor 66 is connected via a resistor $R_6$ to ground. The base of transistor 66 is connected via a resistor $R_6$ to supply voltage $U_{BATT}$.

As a result of the circuit arrangement illustrated in FIG. 9, transistor 62 is switched through, if the transformed spark voltage rises above supply voltage $U_{BATT}$. Resistors $R_6$ function as highly resistive protective resistors for transistor 62 in response to the clamping of switching arrangement 30. Zener diode 60' has a breakdown voltage of, for example, 50 V, so that the maximum collector-emitter voltage of transistor 66 is limited.

In the circuit illustrated in FIGS. 1, 8, and 9, the assumption has been made that spark plug 12 has two electrodes 18 and 22 that are insulated against each other and are arranged so as to be insulated with respect to ground.

Figure 10:
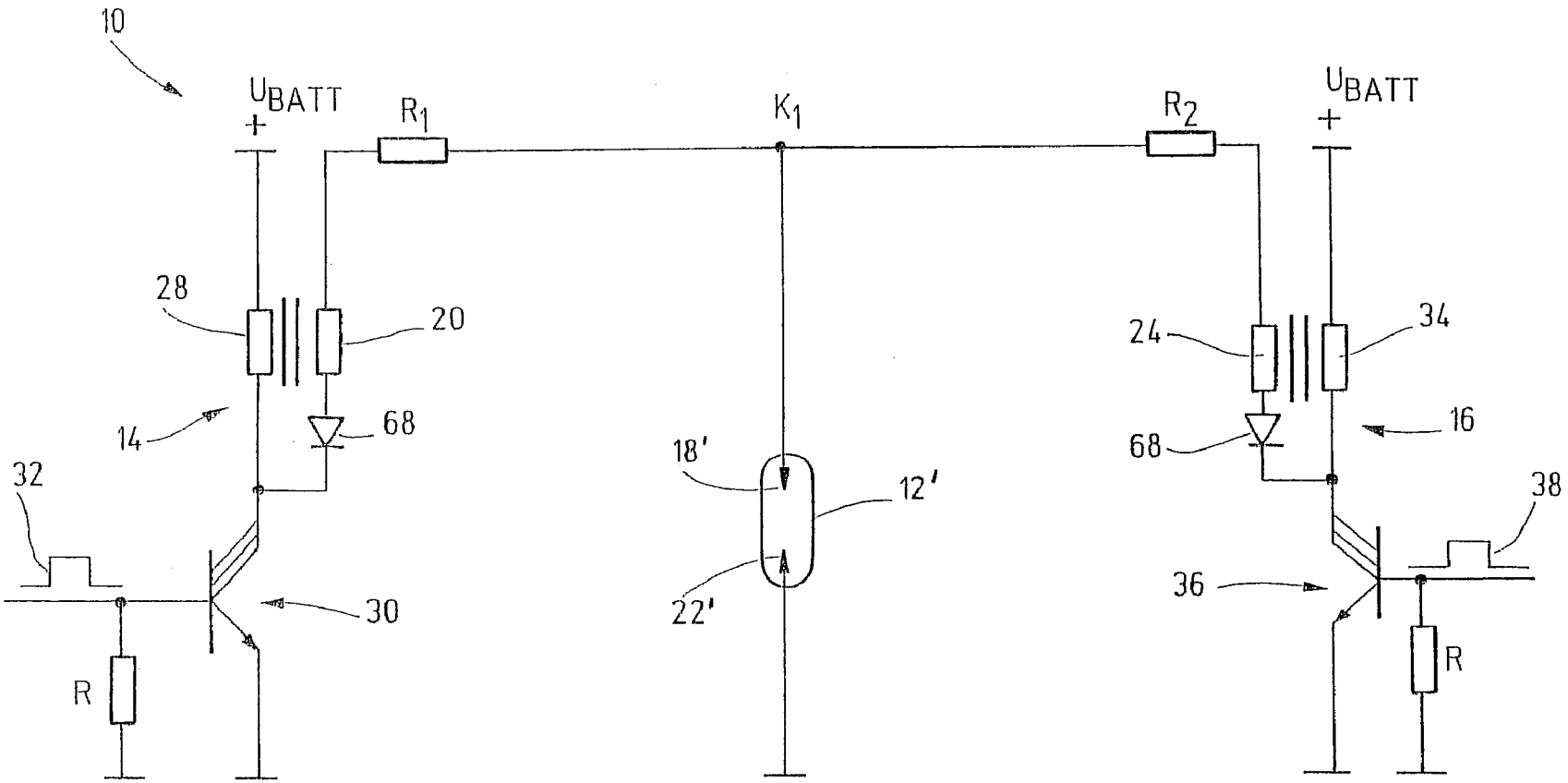

Standard spark plugs 12' have an electrode 18', that emerges in an insulated fashion, and a ground electrode 22'. FIG. 10 illustrates a circuit arrangement of ignition system 10, in which a spark plug 12' having a ground electrode may also be used in a double-coil ignition system. In this context, electrode 18' of spark plug 12' is connected to a nodal point $K_1$, which is connected via resistor $R_1$, to secondary winding 20 of first ignition coil 14 and via resistor $R_2$ to secondary winding 24 of second ignition coil 16. In this circuit variant, it is possible in each case for a high-voltage diode 68 to be connected to the secondary circuit of ignition coils 14 and 16, which function to suppress the so-called switch-on ignition spark. Finally, the functioning of circuit arrangement 10 illustrated in FIG. 10 may be compared to the switching arrangements that have already been discussed.

Switching arrangements 30, 36 as well as the optionally present further switching components may be integrated into one monolithic component.

What is claimed is:

1. An ignition system for an internal combustion engine, comprising:

an ignition device that requires a high voltage to ignite an ignition spark;

a spark plug;

two switching arrangements;

two ignition coils having secondary windings each connected to electrodes of the spark plug and primary windings connectable via a corresponding switching arrangement to a supply voltage source; and a drive circuit configured to drive the ignition coils in a time-displaced manner.

2. The ignition system according to claim 1, wherein the high voltage corresponds to an ignition voltage.

3. The ignition system according to claim 1, wherein each switching arrangement includes a Darlington transistor.

4. The ignition system according to claim 1, further comprising an external drive circuit configured to provide control signals of the switching arrangements.

5. The ignition system according to claim 4, wherein the external drive circuit includes an engine control device.

6. The ignition system according to claim 1, further comprising an external drive circuit configured to provide a control signal for a first one of the switching arrangements, a control signal for a second one of the switching arrangements provided as a function of an operating parameter of the ignition system.

7. The ignition system according to claim 6, further comprising an arrangement configured to provide the control signal for the second one of the switching arrangements in response to exceeding a specifiable spark voltage of the ignition spark of the spark plug.

8. The ignition system according to claim 7, further comprising a Zener diode, the specifiable spark voltage determined in accordance with a breakdown voltage of the Zener diode.

9. The ignition system according to claim 7, wherein the specifiable spark voltage is determined in accordance with a supply voltage.

* * * * *